US010974251B2

(12) United States Patent
Kashima et al.

(10) Patent No.: US 10,974,251 B2
(45) Date of Patent: Apr. 13, 2021

(54) PULVERIZING DEVICE, THROAT FOR PULVERIZING DEVICE, AND PULVERIZED-COAL FIRED BOILER

(71) Applicant: MITSUBISHI HITACHI POWER SYSTEMS, LTD., Yokohama (JP)

(72) Inventors: Jun Kashima, Tokyo (JP); Shinji Matsumoto, Tokyo (JP); Kosuke Kitakaze, Yokohama (JP); Yasuhito Onishi, Yokohama (JP); Hiroaki Kanemoto, Yokohama (JP)

(73) Assignee: MITSUBISHI POWER, LTD., Yokohama (JP)

( * ) Notice: Subject to any disclaimer, the term of this patent is extended or adjusted under 35 U.S.C. 154(b) by 182 days.

(21) Appl. No.: 16/075,201

(22) PCT Filed: Jan. 13, 2017

(86) PCT No.: PCT/JP2017/000954
§ 371 (c)(1),
(2) Date: Aug. 3, 2018

(87) PCT Pub. No.: WO2017/138295
PCT Pub. Date: Aug. 17, 2017

(65) Prior Publication Data

US 2018/0372313 A1 Dec. 27, 2018

(30) Foreign Application Priority Data

Feb. 9, 2016 (JP) ..... JP2016-022848

(51) Int. Cl.
*B02C 15/00* (2006.01)
*B02C 15/04* (2006.01)
(Continued)

(52) U.S. Cl.
CPC ..... *B02C 15/007* (2013.01); *B02C 15/001* (2013.01); *B02C 15/003* (2013.01);
(Continued)

(58) Field of Classification Search
CPC ..... B02C 15/001; B02C 15/003; B02C 15/04; B02C 15/007; B02C 2015/002;
(Continued)

(56) References Cited

U.S. PATENT DOCUMENTS 4,264,041 A * 4/1981 Kitto, Jr. ..... B02C 15/001 241/57
6,092,748 A 7/2000 Keyssner et al.
(Continued)

FOREIGN PATENT DOCUMENTS

JP 62-144548 U 9/1987
JP 6-226128 A 8/1994
(Continued)

OTHER PUBLICATIONS

Office Action dated Aug. 17, 2019, issued in counterpart KR Application No. 10-2018-7022601, with English translation (10 pages).
(Continued)

*Primary Examiner* — Shelley M Self
*Assistant Examiner* — Teresa A Guthrie
(74) *Attorney, Agent, or Firm* — Westerman, Hattori, Daniels & Adrian, LLP

(57) ABSTRACT

A pulverizing device includes: a housing; a pulverization table configured to rotate inside the housing; and a throat, disposed inside the housing on a radially outer side of the pulverization table, for forming an upward air flow. The throat includes: an inner ring extending along an outer periphery of the pulverization table; an outer ring, disposed on a radially outer side of the inner ring so as to form an
(Continued)

annular flow passage between the inner ring and the outer ring; and a plurality of throat vanes disposed between the inner ring and the outer ring. The following expressions are satisfied: $2.0 \leq L/d \leq 4.0$; and $0.5 \leq H/d \leq 1.5$, where H is a gap between the inner ring and the outer ring with respect to a radial direction, L is a length of the throat vanes, and 'd' is a distance between adjacent two of the throat vanes.

7 Claims, 10 Drawing Sheets

(51) Int. Cl.

| | |
|---|---|
| ***F23K 1/00*** | (2006.01) |
| ***F23C 99/00*** | (2006.01) |
| ***F23D 1/00*** | (2006.01) |
| ***F23K 3/02*** | (2006.01) |

(52) U.S. Cl.
CPC ..... *B02C 15/04* (2013.01); *F23C 99/005* (2013.01); *F23D 1/00* (2013.01); *F23K 1/00* (2013.01); *F23K 3/02* (2013.01); *F23K 2201/1003* (2013.01); *F23K 2203/201* (2013.01)

(58) Field of Classification Search
CPC ... B02C 23/24; F23K 3/02; F23K 1/00; F23K 2201/1003; F23K 2203/201; F23C 99/005; F23D 1/00
USPC ..... 241/18, 19, 119
See application file for complete search history.

(56) References Cited

U.S. PATENT DOCUMENTS

| | | | | |
|---|---|---|---|---|
| 7,654,396 | B2 | 2/2010 | Takeno et al. | |
| 8,651,032 | B2 * | 2/2014 | Otani | B02C 15/04 110/232 |
| 9,636,684 | B2 | 5/2017 | Takeno et al. | |
| 2014/0353411 | A1 | 12/2014 | Colson | |
| 2015/0321197 | A1 * | 11/2015 | Takeno | B02C 15/007 241/58 |

FOREIGN PATENT DOCUMENTS

| | | | | |
|---|---|---|---|---|
| JP | 10-128140 | A | 5/1998 | |
| JP | 2000-93822 | A | 4/2000 | |
| JP | 2013-103212 | A | 5/2013 | |
| JP | 2013-198883 | A | 10/2013 | |
| JP | 5791556 | B2 | 10/2015 | |
| KR | 10-2010-0063759 | A | 6/2010 | |
| KR | 10-2014-0138241 | A | 12/2014 | |
| WO | WO-2013146678 | A1 * | 10/2013 | F23K 1/00 |

OTHER PUBLICATIONS

International Search Report dated Feb. 7, 2017, issued in counterpart International Application No. PCT/JP2017/000954 (2 pages).
Office Action dated Aug. 3, 2020, issued in counterpart IN Application No. 201817028633, with English translation (5 pages).

* cited by examiner

PULVERIZING DEVICE, THROAT FOR PULVERIZING DEVICE, AND PULVERIZED-COAL FIRED BOILER

TECHNICAL FIELD

The present disclosure relates to a pulverizing device, a throat for a pulverizing device, and a pulverized-coal fired boiler having the same.

BACKGROUND ART

A known pulverizing device pulverizes a to-be-pulverized material, such as a solid fuel, into particles on a pulverization table.

For instance, Patent Documents 1 and 2 disclose a pulverizing device which pulverizes a to-be-pulverized material on a pulverization table with a pulverization roller into pulverized particles, which are then moved upward by primary air (carrier gas) supplied from a throat disposed around the pulverization table to be sent to a classifying part. The classifying part classifies the pulverized particles into coarse particles and micro-particles, and the micro-particles are sent to a consumer.

Patent Document 2 discloses a configuration of a throat for adjusting the flow velocity of carrier gas that blows upward from the throat, to suppress fall of pulverized particles from the throat.

CITATION LIST

Patent Literature

Patent Document 1: JP2013-198883A
Patent Document 2: JP2013-103212A

SUMMARY

Problems to be Solved

In a case where the flow velocity of carrier gas supplied from the throat is adjusted to suppress fall of pulverized particles from the throat as disclosed in Patent Document 2, though increasing the flow velocity of the carrier gas makes it possible to suppress fall of pulverized particles, it may also increase pressure loss of the carrier gas passing through the throat (hereinafter, also referred to as "throat pressure loss"), and increase power required for operation.

In view of the above, an object of at least one embodiment of the present invention is to suppress an amount of pulverizing particles that fall from the throat (hereinafter, also referred to as merely "fall amount"), while also suppressing an increase in pressure loss inside the housing, to suppress a power increase of a pulverizing device.

Solution to the Problems (1) A pulverizing device according to at least one embodiment of the present invention includes: a housing; a pulverization table configured to rotate inside the housing; and a throat, disposed inside the housing on a radially outer side of the pulverization table, for forming an upward air flow. The throat includes: an inner ring extending along an outer periphery of the pulverization table; an outer ring, disposed on a radially outer side of the inner ring so as to form an annular flow passage between the inner ring and the outer ring; and a plurality of throat vanes disposed between the inner ring and the outer ring. The following expressions (a) and (b) are satisfied:

$$2.0 \leq L/d \leq 4.0 \quad \text{(a)}$$

$$0.5 \leq H/d \leq 1.5 \quad \text{(b)}$$

where H is a gap, with respect to a radial direction, between the inner ring and the outer ring, L is a length of the throat vanes, and 'd' is a distance between adjacent two of the throat vanes.

With the above configuration (1), by satisfying 2.0≤L/d, the air flow is contracted sufficiently inside the throat, and the accelerated air flow is injected from the upper side of the pulverization table. With the kinetic energy of the accelerated air flow, it is possible to keep the pulverized particles above the throat, and to suppress fall from the throat. Further, by satisfying L/d≤4.0, it is possible to reduce the length of the flow contraction part, and suppress the throat pressure loss.

Furthermore, the gap H is a value substantially determined by the cross-sectional area of the throat. Thus, H/d depends on the value of 'd', that is, the number of throat vanes. The smaller the distance 'd', the greater the number of the throat vanes, and the to-be-pulverized material is stirred up more frequently, which makes it less likely for the pulverized particles to fall down the throat. Thus, by satisfying 0.5≤H/d, it is possible to reduce the fall amount.

On the other hand, if too many throat vanes are provided, the throat pressure loss increases. Thus, by satisfying H/d≤1.5, it is possible to suppress an increase in the throat pressure loss.

Accordingly, by satisfying the above expressions (a) and (b), it is possible to reduce the fall amount while suppressing an increase in the pressure loss of the air flow passing through the throat, and thus to suppress a power increase of the pulverizing device.

(2) In some embodiments, in the above configuration (1), each throat vane is oblique toward an upstream side, with respect to a rotational direction of the throat, from a lower end toward an upper end of the throat vane, and, the following expression (c) is satisfied:

$$45° \leq \theta \leq 60° \quad \text{(c)}$$

where θ is an inclination angle of the throat vanes with respect to a rotational center axis of the throat.

With the above configuration (2), the throat vane is oblique toward the upstream side with respect to the rotational direction of the throat, from the lower end toward the upper end of the throat vane, and thus each throat vane has an improved effect to stir the pulverized particles upward.

Further, by satisfying 45°≤θ, it is possible to stir the pulverized particles upward with the throat vanes effectively, and thus reduce the fall amount. Accordingly, it is possible to reduce the values of L/d and H/d for achieving a fall amount not greater than a predetermined value, and to reduce the size of the portion around the throat of the pulverizing device. Further, by satisfying θ≤60°, it is possible to suppress the throat pressure loss.

(3) In some embodiments, in the above configuration (1) or (2), each throat vane is oblique toward an upstream side, with respect to a rotational direction of the throat, from a lower end toward an upper end of the throat vane, and, the following expression (d) is satisfied:

$$H/d \geq 0.95 \times (\sin\theta)^{-2.0} \times (L/d)^{-1.2} \quad \text{(d)}$$

where θ is an inclination angle of the throat vanes with respect to a rotational center axis of the throat.

The present inventors studied the influence of the changes in H/d and L/d on the fall amount, and found that, to achieve a desired fall amount, H/d can be increased to reduce L/d, and conversely, L/d can be increased to reduce H/d. The reason can be described as follows. That is, if the distance 'd' between the throat vanes is small compared to the radial-directional gap H between the inner ring and the outer ring (i.e., the number of throat vanes is relatively large), it is possible to expect the effect of the throat vanes to stir the pulverized particles upward, and thus it is possible to achieve a desired fall amount even if L/d is relatively small. On the other hand, if the length L of the throat vane is large compared to the distance 'd' between adjacent throat vanes, it is possible to suppress fall of pulverized particles by contracting the air flow sufficiently inside the throat, and thus it is possible to achieve a desired fall amount even if H/d is small.

Further, the present inventors conducted intensive researches and found that, the combination of H/d and L/d capable of achieving a desired fall amount depends on the inclination angle θ. Specifically, the greater the angle sin θ is, the smaller values H/d and L/d for achieving a desired fall amount become relatively. This is because, for L×sin θ represents the extension range of each throat vane in the throat circumferential direction, sin θ can be considered as a parameter representing the magnitude of the effect to stir the pulverized particles upward.

The above configuration (3) is based on the above findings by the present inventors, and requires the expression (d) to be satisfied, which indicates the combination of H/d, L/d, sin θ for suppressing the fall amount more effectively. Accordingly, by setting H/d, L/d, and θ so as to satisfy the expression (d), in addition to the expressions (a) and (b), it is possible to reduce the fall amount of pulverized particles more effectively while suppressing an increase in the throat pressure loss.

(4) In some embodiments, in any one of the above configurations (1) to (3), the inner ring includes a flow guide portion for guiding an air flow which flows from below into the annular flow passage, the flow guide portion being disposed on a lower end side of the inner ring and having a curved shape so as to become closer to an inner side, with respect to the radial direction, toward a lower end of the inner ring.

An air flow is supplied from a lateral side of the pulverizing device into the annular flow passage, and thus flow deviation is observed along the circumferential direction of the throat. Under the presence of the flow deviation, the fall amount increases at a portion with a low flow rate.

With the above configuration (4), with the flow guide portion, it is possible to suppress the flow deviation at the throat, and thus it is possible to make the fall amount uniform along the circumferential direction of the throat.

(5) In some embodiments, in any one of the above configurations (1) to (4), a circumferential speed of the pulverization table is not less than 3 m/s and not more than 5 m/s.

In a region with where the circumferential speed of the pulverization table (hereinafter, also referred to as table circumferential speed) is low, as the table circumferential speed increases, the centrifugal force acting on the to-be-pulverized material increases. Thus, the amount of pulverized particles that move to the throat from the pulverization table increases, and the fall amount increases.

Furthermore, as the table circumferential speed increases, the throat vanes stir the pulverized particles upward with a greater force, and thus the increase in the fall amount attenuates. Thus, with an increase in the table circumferential speed, the fall amount converges to a constant value.

With the table circumferential speed being 3 m/s or higher, it is possible to converge the fall amount to a constant value, while ensuring a pulverizing performance (capacity).

Furthermore, with the table circumferential speed being 5 m/s or lower, it is possible to perform eco-friendly operation in which a power increase of the pulverizing device can be avoided.

(6) A throat for the pulverizing device according to any one of the above configurations (1) to (5) includes: the inner ring; the outer ring, disposed on a radially outer side of the inner ring, for forming an annular flow passage between the inner ring and the outer ring; and the plurality of throat vanes disposed between the inner ring and the outer ring. The following expressions (a) and (b) are satisfied $$2.0 \leq L/d \leq 4.0 \quad \text{(a)}$$

$$0.5 \leq H/d \leq 1.5 \quad \text{(b)}$$

where H is a gap, with respect to a radial direction, between the inner ring and the outer ring, L is a length of the throat vanes, and 'd' is a distance between adjacent two of the throat vanes.

With the above configuration (6), as described above, it is possible to reduce the fall amount by satisfying 2.0≤L/d, and it is possible to suppress the pressure loss of the air flow passing through the throat, by satisfying L/d≤4.0.

Furthermore, it is possible to suppress the fall amount by satisfying 0.5≤H/d, and suppress the pressure loss of the air flow passing through the throat by satisfying H/d≤1.5 (preferably, H/d≤1.0).

(7) In some embodiments, in any one of the above configurations (1) to (5), the pulverizing device is configured to pulverize coal as a to-be-pulverized material.

With the above configuration, in a case where the to-be-pulverized material is coal, it is possible to suppress the pressure loss of the air flow passing through the throat, while reducing the fall amount of pulverized coal particles that fall from the throat.

(8) A pulverized-coal fired boiler according to at least one embodiment of the present invention includes: the pulverizing device having the above configuration (7); and a furnace for combusting pulverized coal obtained by the pulverizing device.

With the above configuration (8), with the above pulverizing device, it is possible to reduce the fall amount of pulverized coal particles that fall from the throat, and suppress the pressure loss of carrier gas that passes through the throat.

Further, to achieve the above, it is not necessary to increase the flow velocity of the air flow (carrier gas) by increasing the ratio of the air flow (carrier gas) to the coal particles. Thus, in a case where coal particles are combusted with a pulverized-coal fired boiler, there is no risk of deteriorating the combustion performance such as the ignition performance.

Advantageous Effects

According to at least one embodiment of the present invention, the maintainability of the pulverizing device is improved by reducing the fall amount, and the power increase of the pulverizing device is suppressed by suppressing the pressure loss of the air flow.

DETAILED DESCRIPTION

Embodiments of the present invention will now be described in detail with reference to the accompanying drawings. It is intended, however, that unless particularly identified, dimensions, materials, shapes, relative positions and the like of components described in the embodiments shall be interpreted as illustrative only and not intended to limit the scope of the present invention.

For instance, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

For instance, an expression of an equal state such as "same" "equal" and "uniform" shall not be construed as indicating only the state in which the feature is strictly equal, but also includes a state in which there is a tolerance or a difference that can still achieve the same function.

Further, for instance, an expression of a shape such as a rectangular shape or a cylindrical shape shall not be construed as only the geometrically strict shape, but also includes a shape with unevenness or chamfered corners within the range in which the same effect can be achieved.

On the other hand, an expression such as "comprise", "include", "have", "contain" and "constitute" are not intended to be exclusive of other components.

Figure 1:
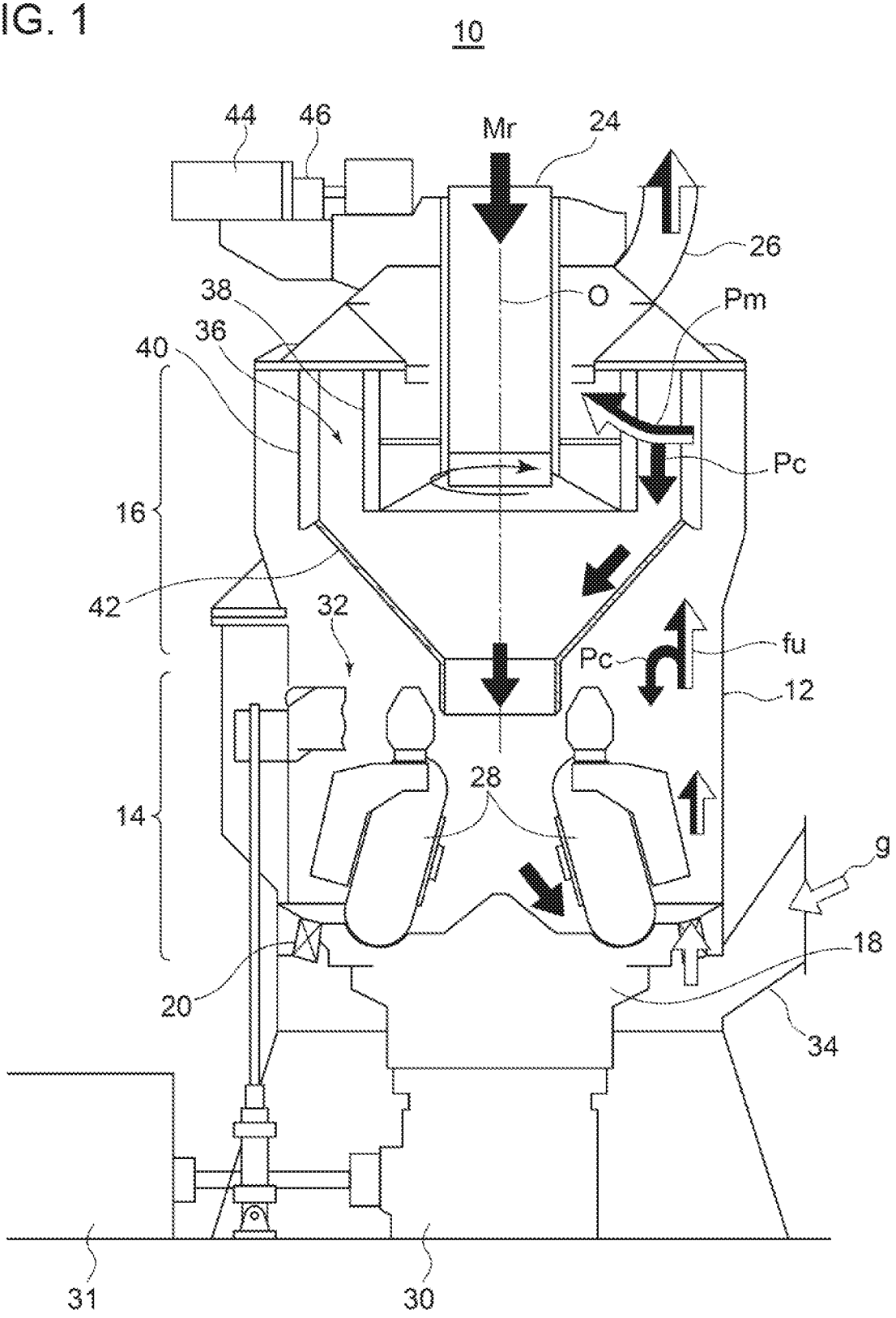
FIG. 1 is a front cross-sectional view of a pulverizing device according to an embodiment.
Figure 2:
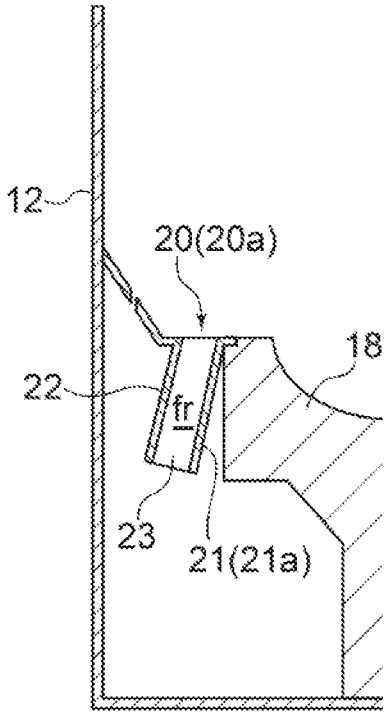
FIG. 2 is a cross-sectional view of a throat portion according to an embodiment.
Figure 3:
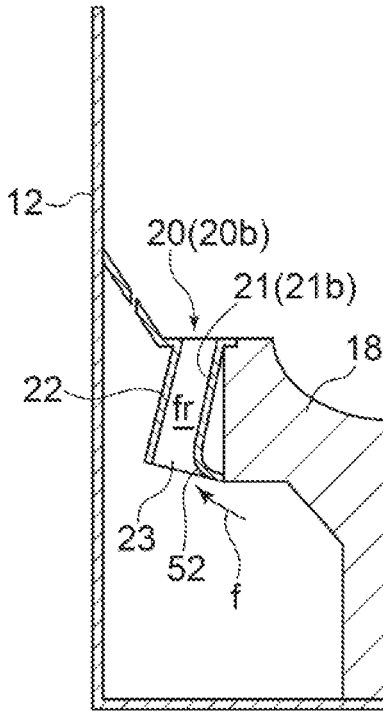
FIG. 3 is a lateral cross-sectional view of a throat portion according to an embodiment.

FIG. 1 is a schematic front cross-sectional view of a pulverizing device according to an embodiment. FIGS. 2 and 3 are each a front cross-sectional view of a throat portion according to an embodiment.

As shown in FIG. 1, a pulverizing device 10 according to an embodiment includes a housing 12, and a pulverizing part 14 and a classifying part 16 disposed inside the housing 12.

The pulverizing part 14 includes a pulverization table 18 configured to rotate, and a throat 20 disposed on the radially outer side of the pulverization table 18 for forming an upward air flow 'fu' inside the housing 12. The pulverizing part 14 pulverizes a to-be-pulverized material supplied onto the pulverization table 18 into pulverized particles. The pulverized particles move upward as a two-phase flow including pulverized particles and air, entrained by the upward air flow 'fu' that blows up from the throat 20.

In the illustrated embodiment, the pulverizing device 10 includes a classifying part 16. The classifying part 16 is disposed above the pulverization table 18, and is configured to classify the pulverized particles entrained by the upward air flow 'fu' into micro-particles Pm and coarse particles Pc. The micro-particles Pm are sent to a consumer through the classifying part 16 together with the carrier gas, and the coarse particles Pc separated from the micro-particles Pm return to the pulverization table 18.

As shown in FIGS. 2 and 3, the throat 20 (20*a*, 20*b*) includes an inner ring 21 (21*a*, 21*b*) extending along the outer periphery of the pulverization table 18, and an outer ring 22 disposed on the radially outer side of the inner ring 21 and forming an annular flow passage 'fr' between the outer ring 22 and the inner ring 21.

Figure 4:
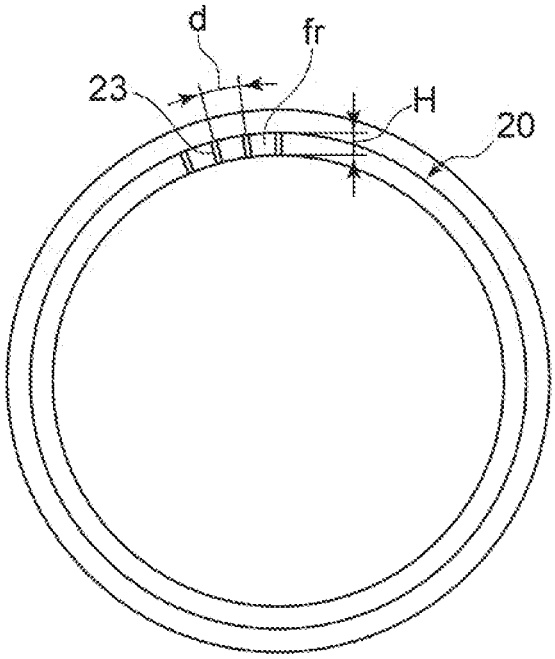
FIG. 4 is a planar view of a throat portion according to an embodiment.

As shown in FIGS. 4 and 5, the throat 20 includes a plurality of throat vanes 23 disposed between the inner ring 21 and the outer ring 22.

The throat 20 is configured to satisfy the following expressions (a) and (b):

$$2.0 \leq L/d \leq 4.0 \quad \text{(a)}$$

$$0.5 \leq H/d \leq 1.5 \quad \text{(b)}$$

where H is a gap, with respect to a radial direction, between the inner ring and the outer ring, L is a length of the throat vanes, and 'd' is a distance between adjacent two of the throat vanes.

By satisfying 2.0≤L/d, it is possible to enhance the contraction flow effect of the air flow passing through the annular flow passage 'fr'. As the contracted and accelerated air flow is injected from an upper side of the pulverization table, it is possible to keep the to-be-pulverized material above the throat with kinetic energy of the air flow, and to reduce the fall amount of the pulverized particles. Furthermore, by satisfying L/d≤4.0, it is possible to suppress the throat pressure loss, and suppress a power increase of the pulverizing device 10.

Furthermore, the smaller the distance 'd', the greater the number of the throat vanes 23, and the to-be-pulverized material is stirred upward more frequently, which makes it less likely for the pulverized particles to fall down the throat. Thus, by satisfying 0.5≤H/d, it is possible to reduce the fall amount.

If the fall amount increases, the fallen pulverized particles cannot be processed in time, which may cause troubles in operation of the pulverizing device 10.

On the other hand, if too many throat vanes are provided, the throat pressure loss increases. Thus, by satisfying H/d≤1.5 (preferably, H/d≤1.0), it is possible to suppress an increase in the throat pressure loss.

Accordingly, by satisfying the above relationships (a) and (b), it is possible to suppress the fall amount while suppressing an increase in the pressure loss of the air flow passing through the throat, and thus to suppress a power increase of the pulverizing device 10.

Figure 5A:
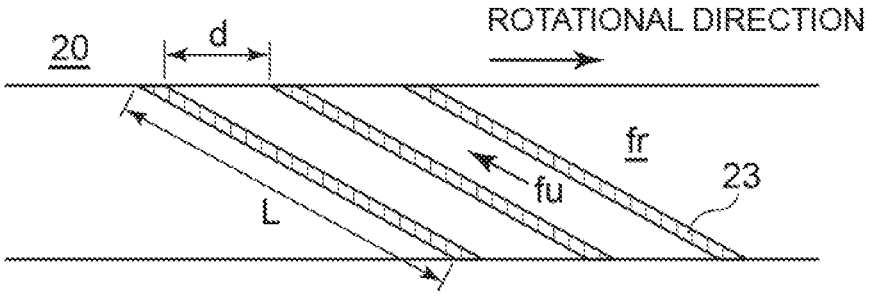
FIG. 5A is a partial enlarged cross-sectional view of a throat portion according to an embodiment, and a FIG. 5B is a partial enlarged view of a throat portion according to a comparative example.
Figure 5B:
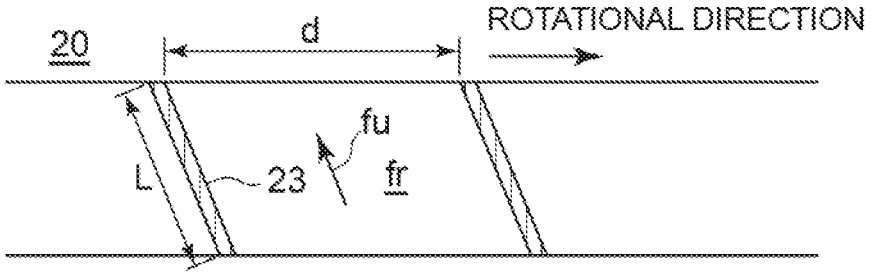

FIG. 5A shows a configuration example of the throat 20 satisfying the relationships (a) and (b). FIG. 5B is a configuration example of the throat 20 not satisfying the relationships (a) and (b).

FIGS. 6 to 9 are graphs showing findings of the present inventors for a case where the to-be-pulverized material is coal.

Figure 6:
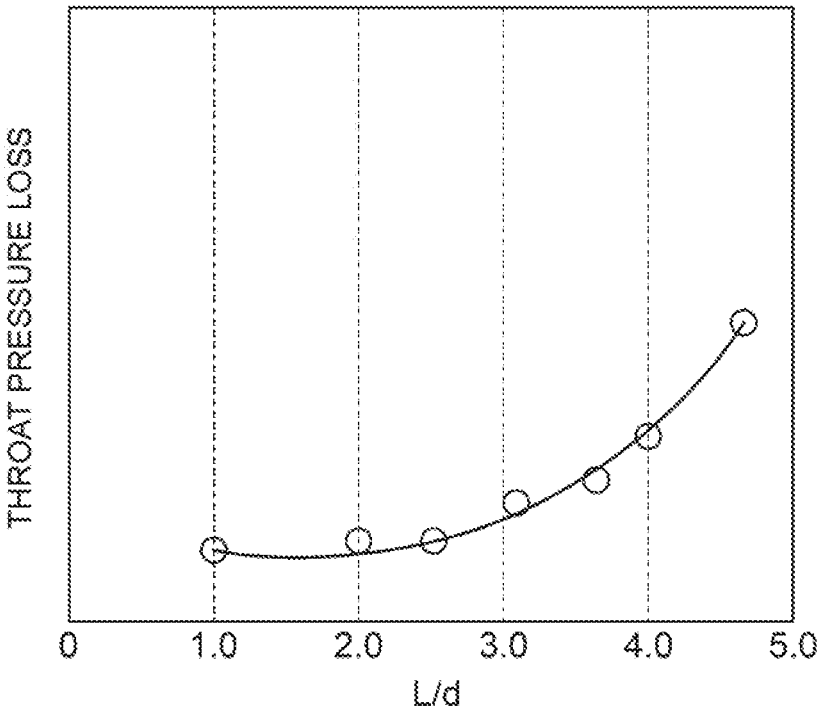
FIG. 6 is a graph showing a relationship between L/d and the throat pressure loss.
Figure 7:
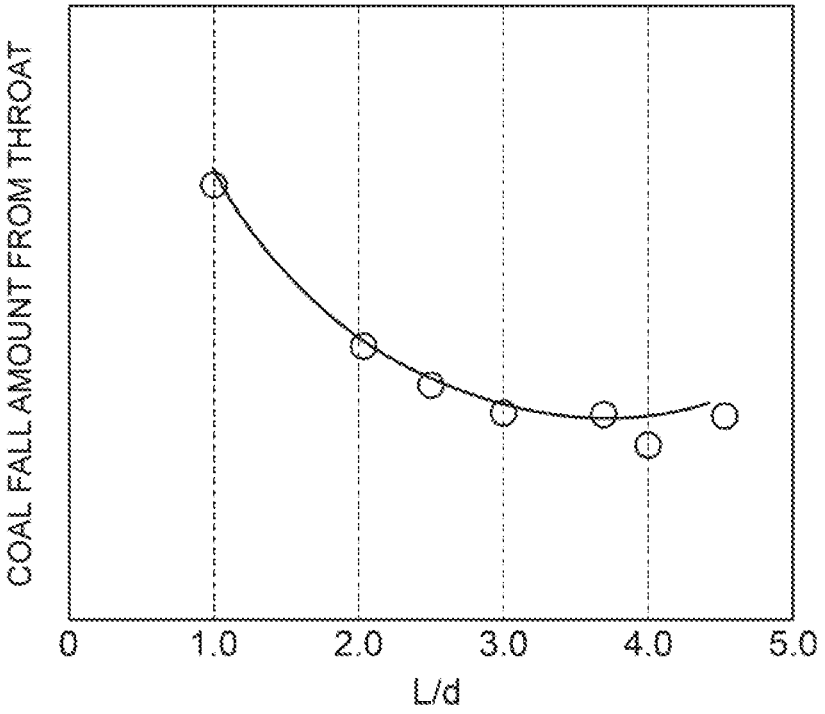
FIG. 7 is a graph showing a relationship between L/d and the fall amount from the throat.

FIG. 6 is a graph showing a relationship between L/d and the throat pressure loss, and FIG. 7 is a graph showing a relationship between L/d and the amount of coal particles that fall from the throat. FIG. 6 shows that the throat pressure loss is low when L/d is not greater than 2.0, and as the L/d increases, the throat pressure loss tends to increase from around 3.0. FIG. 7 shows that, while the fall amount decreases with an increase in L/d, the fall amount decreases no more and stays substantially constant once L/d becomes not smaller than 3.0. Furthermore, the fall amount tends to increase when L/d exceeds 4.0. From FIGS. 6 and 7, it is clear that, by satisfying $2.0 \leq L/d \leq 4.0$, it is possible to reduce the fall amount while suppressing an increase in the throat pressure loss.

Figure 8:
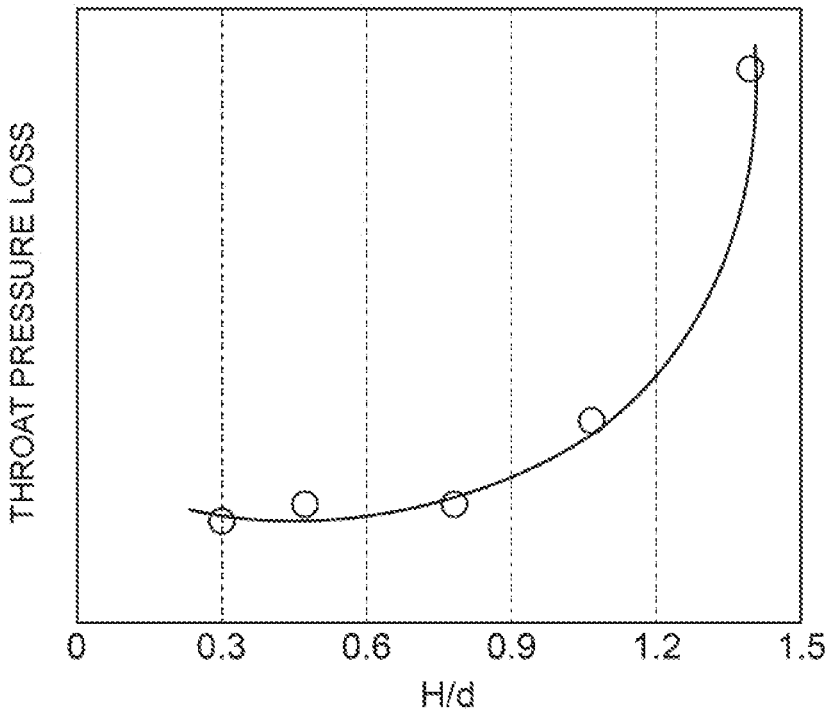
FIG. 8 is a graph showing a relationship between H/d and the throat pressure loss.
Figure 9:
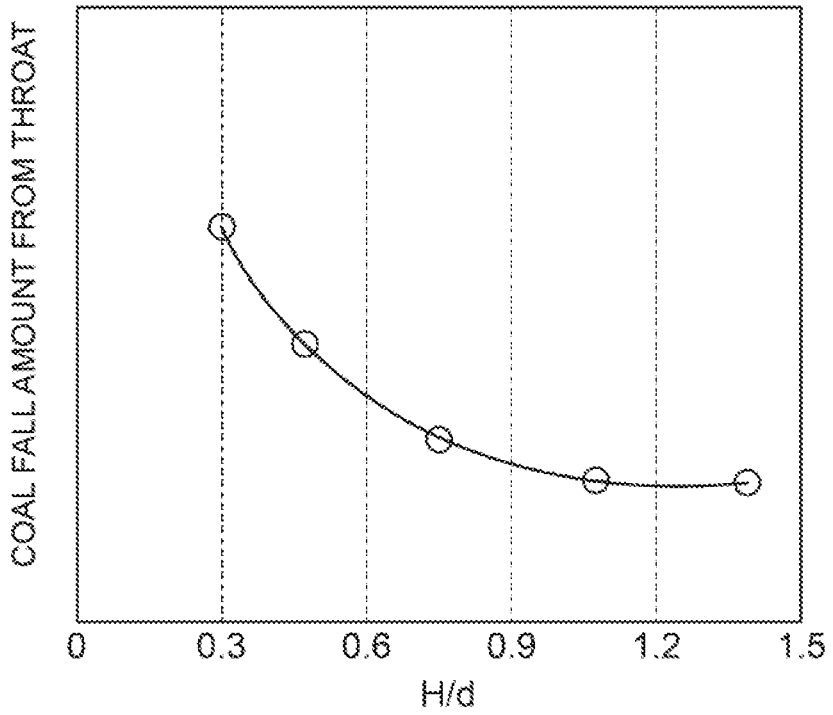
FIG. 9 is a graph showing a relationship between H/d and the fall amount from the throat.

FIG. 8 is a graph showing a relationship between H/d and the throat pressure loss, and FIG. 9 is a graph showing a relationship between H/d and the amount of coal particles that fall from the throat. FIG. 8 shows that, while the throat pressure loss increases with an increase in H/d within the range $H/d>1$, the change in throat pressure loss relative to H/d is small within the range $H/d \leq 1$. Furthermore, within the range $H/d \leq 0.5$, the throat pressure loss is substantially constant. FIG. 9 shows that, while the fall amount decreases with an increase in H/d, the fall amount does not change much within the range $H/d>1$, even though H/d increases. Within the range $H/d<0.5$, the fall amount increases rapidly with a decrease in H/d.

Accordingly, from FIGS. 8 and 9, it is clear that it is possible to reduce the fall amount by satisfying $0.5 \leq H/d \leq 1.5$, and preferably, it is possible to suppress both of the throat pressure loss and the fall amount by satisfying $H/d \leq 1.0$.

In an illustrative embodiment, as shown in FIG. 3, the inner ring 21 (21*b*) of the throat 20 (20*b*) includes a flow guide portion 52 formed in a lower end region of the inner ring 21 (21*b*). The flow guide portion 52 has a shape curved so as to become closer to the inner side, with respect to the radial direction, toward the lower end of the inner ring 21 (21*b*). The flow guide portion 52 guides the air flow 'f' that enters the annular flow passage 'fr' from below.

The air flow 'f' is supplied from a lateral side of the pulverizing device 10 of the annular flow passage 'fr', and thus flow deviation is observed along the circumferential direction of the throat 20. Under the presence of flow deviation, the fall amount increases at a portion with a low flow rate.

With the above configuration, with the flow guide portion 52, it is possible to suppress the flow deviation at the throat 20 (20*b*), and thus it is possible to make the fall amount uniform along the circumferential direction of the throat 20 (20*b*).

In the illustrated embodiment, as shown in FIG. 1, the pulverizing device includes a supply pipe 24 for supplying a to-be-pulverized material, through which the to-be-pulverized material Mr is fed, and a micro-particle discharge part 26 for discharging the pulverized and classified micro-particles Pm outside. The micro-particle discharge part 26 includes a tubular discharge pipe, for instance.

The supply pipe 24 is disposed in the vertical direction on an upper part of the housing 12 such that the axis of the supply pipe 24 is along the center axis O of the housing 12. The to-be-pulverized material Mr fed through the supply pipe 24 is supplied onto the pulverization table 18. The supply pipe 24 is supported on the housing 12 rotatably in the direction of the arrow, via a bearing (not shown).

The discharge part 26 is disposed above the classifying part 16, so as to be in communication with the classifying part 16. The micro-particles Pm classified in the classifying part 16 is discharged outside through the discharge part 26.

In the illustrated embodiment, the pulverizing part 14 includes a pulverization table 18 and a pulverization roller 28 for pulverizing the to-be-pulverized material Mr. The to-be-pulverized material Mr supplied onto the pulverization table 18 is pulverized through engagement between the pulverization table 18 and the pulverization roller 28. The pulverization table 18 is rotated by a drive part 30 driven by a motor 31.

The to-be-pulverized material Mr on the pulverization table 18 is moved toward the radially outer side on the pulverization table 18 due to a centrifugal force generated by rotation of the pulverization table 18, and pulverized through engagement between the pulverization table 18 and the pulverization roller 28. The pulverization roller 28 is configured to be pushed against the pulverization table 18 by a pressurizing device 32.

A carrier gas 'g' supplied from a carrier gas duct 34 forms an air flow which blows upward from the throat 20 into the housing 12. A plurality of throat vanes 23 disposed on the throat 20 impart swirls along the housing circumferential direction to the carrier gas 'g', and the carrier gas 'g' forms an upward air flow 'fu'.

The pulverized particles obtained by pulverizing the to-be-pulverized material Mr move upward through the radially outer region inside the housing 12, entrained by the upward air flow 'fu' formed by the carrier gas 'g'. During the upward movement, a part of coarse particles Pc included in the pulverized particles falls due to gravity classification, and returns to the pulverization table 18.

In the illustrated embodiment, the classifying part 16 includes an annular rotational part 36 which is rotatable about the center axis O of the housing 12. The annular rotational part 36 is mounted to the supply pipe 24, and rotates together with the supply pipe 24. The annular rotational part 36 includes a plurality of rotational fins 38 arranged at intervals around the rotational axis O.

On the outer side of the annular rotational part 36, a plurality of fixed fins 40 are disposed at intervals in an annular pattern, around the center axis O. A flow guide cone 42 is disposed below the fixed fins 40.

At the classifying part 16, the pulverized particles are classified into micro-particles Pm and coarse particles Pc, through centrifugal classification by the fixed fins 40 and the rotational fins 38, and collision classification by collision of the coarse particles Pc with the fixed fins 40 and the rotational fins 38.

In an embodiment in which the fixed fins 40 and the flow guide cone 42 are not provided, the plurality of rotational fins 40 are disposed directly facing the region in which the upward air flow 'fu' exists, within the interior space of the housing 12. For instance, no hopper is disposed at the height position between the annular rotational part 36 and the pulverizing part 14, and thus there is no member that blocks the air flow between the rotational fins 40 of the annular rotational part 36 and the pulverizing part 14.

Thus, it is possible to reduce the size of the housing 12, and to return coarse particles Pc that cannot pass the classifying part 16 to the pulverizing part 14 smoothly from a region where the flow velocity of the upward air flow 'fu' is relatively low.

Accordingly, it is possible to suppress stagnation of coarse particles Pc near the annular rotational part 36. Thus, it is possible to improve the fineness of the micro-particles Pm at the outlet side of the classifying part, and to promote re-pulverization of the coarse particles Pc at the pulverizing part 14.

In the illustrated embodiment, the motor 44 is disposed on an upper side of the housing 12, and the output of the motor 44 is transmitted to the supply pipe 24 via a speed reducer 46. In response to rotation of the motor 44, the annular rotational part 36 rotates about the center axis O together with the supply pipe 24.

Figure 10:
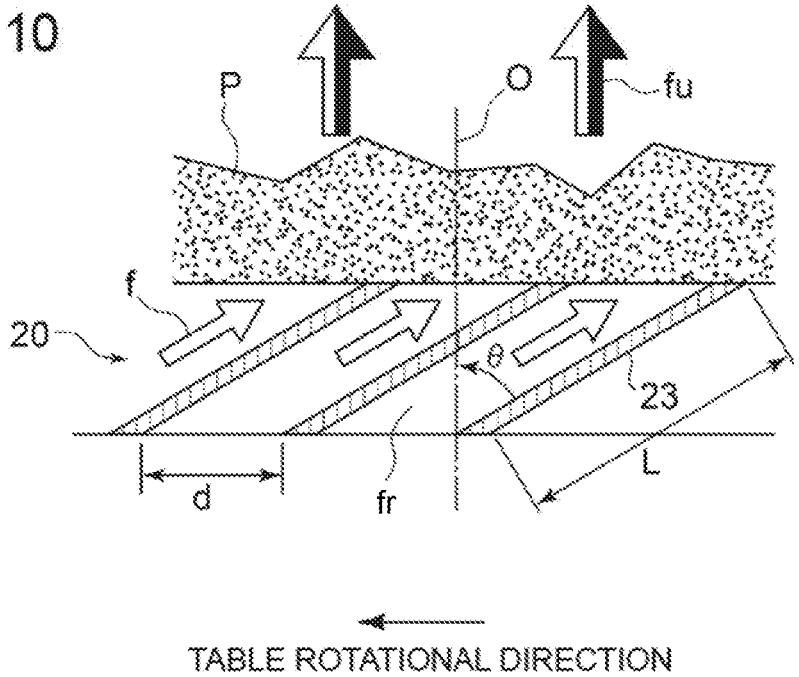
FIG. 10 is a cross-sectional view of a throat portion according to an embodiment.

In an illustrative embodiment, as shown in FIG. 10, each throat vane 23 is oblique toward the upstream side with respect to the rotational direction of the throat 20, from the lower end toward the upper end of the throat vane 23. Further, the following expression (c) is satisfied:

$$45° \leq \theta \leq 60° \quad \text{(c)}$$

where θ is the inclination angle of the throat vane 23 with respect to the rotational center axis (center axis O) of the throat 20.

With the above configuration, the throat vane 23 is oblique toward the upstream side with respect to the rotational direction of the throat 20, from the lower end toward the upper end of the throat vane 23, and thus each throat vane 23 has an improved effect to stir the pulverized particles P upward.

Further, by satisfying 45°≤θ, it is possible to improve the effect of the throat vanes 23 to stir the pulverized particles P upward, and thus it is possible to reduce the fall amount. Accordingly, it is possible to reduce the values of L/d and H/d for achieving a fall amount not greater than a predetermined value, and to reduce the size of the portion around the throat of the pulverizing device 10. Further, by satisfying θ≤60°, it is possible to suppress the throat pressure loss.

Figure 11:
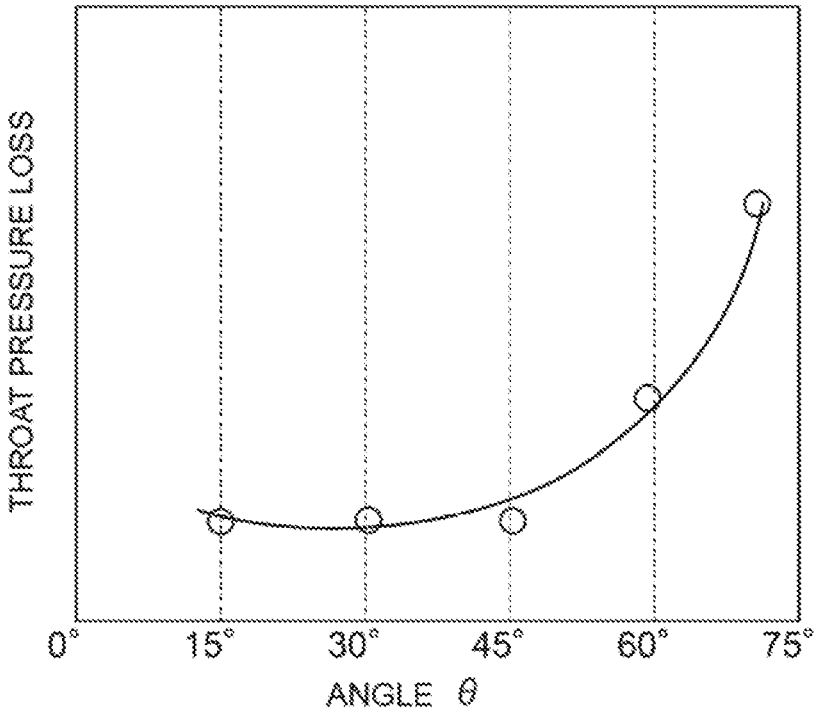
FIG. 11 is a graph showing a relationship between θ and the throat pressure loss.
Figure 12:
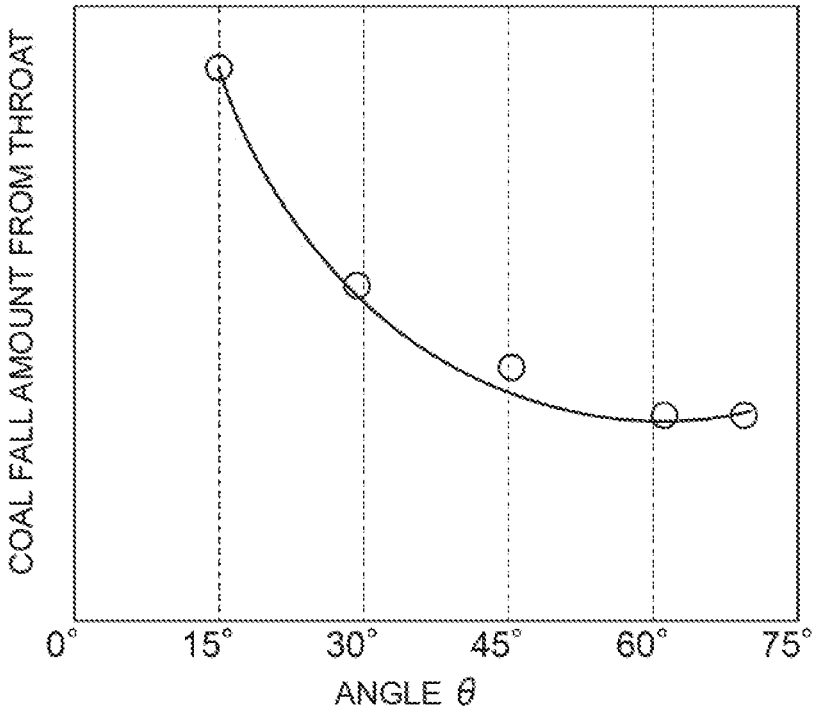
FIG. 12 is a graph showing a relationship between θ and the fall amount from the throat.

FIG. 11 is a graph showing a relationship between θ and the throat pressure loss in a case where the pulverized particles are coal particles, and FIG. 12 is a graph showing a relationship between θ and the fall amount in a similar case.

FIG. 11 shows that the throat pressure loss is at a low level when θ is from 15° to around 45°, and the throat pressure loss increases as θ increases from around 45°, but it is possible to suppress the increase in the throat pressure loss when θ≤60°. Further, FIG. 12 shows that the fall amount decreases with an increase in θ, but the change in the fall amount relative to θ becomes smaller within the range θ≥45°.

From FIGS. 11 and 12, when 45°≤θ≤60° is satisfied, it is possible to reduce both of the throat pressure loss and the fall amount effectively.

In an illustrative embodiment, the table circumferential speed is not less than 3 m/s and not more than 5 m/s.

Figure 13:
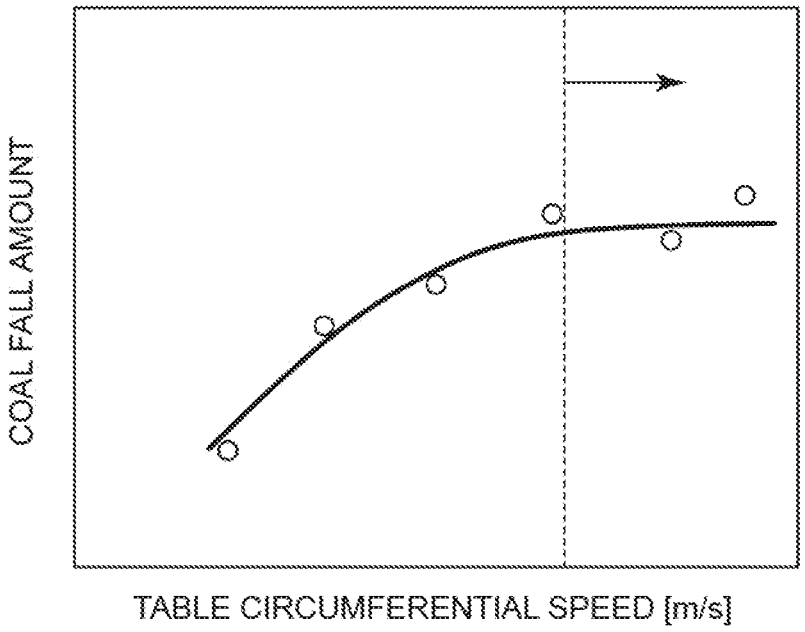
FIG. 13 is a graph showing a relationship between the table circumferential speed and the coal fall amount.

FIG. 13 is a graph showing the relationship between the table circumferential speed and the fall amount of pulverized particles. As shown in FIG. 13, in a region with a low table circumferential speed, as the table circumferential speed increases, the centrifugal force acting on the to-be-pulverized material increases. Thus, a greater amount of pulverized particles move to the throat 20 from the pulverization table 18, and the fall amount increases.

Furthermore, as the table circumferential speed increases, the throat vanes 23 stir the pulverized particles upward with a greater force, and thus the increase in the fall amount attenuates. Thus, as shown in FIG. 13, with an increase in the table circumferential speed, the fall amount converges to a constant value.

Figure 14A:
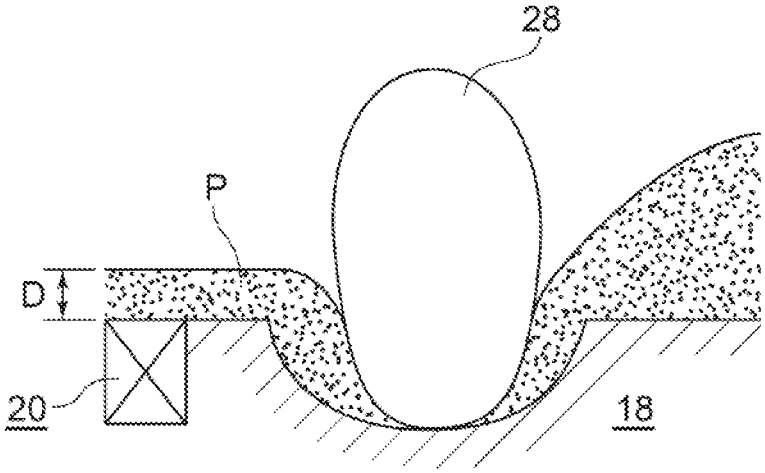
FIGS. 14A and 14B are each a cross-sectional view of a pulverization table according to an embodiment.
Figure 14B:
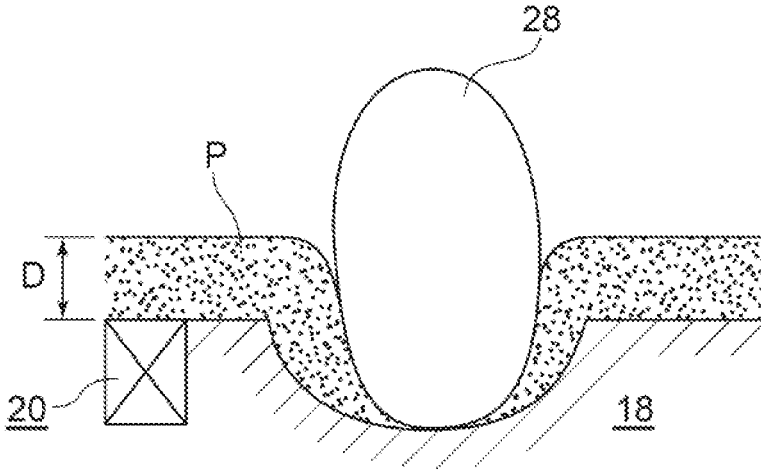

FIG. 14A shows a layer thickness D of the pulverized particles at the time when the table circumferential speed is low. FIG. 14B shows a layer thickness D of the pulverized particles P at the time when the table circumferential speed is high. As shown in FIG. 14A, when the table circumferential speed is low, the layer thickness D of the pulverized particles P is greater toward the inner side with respect to the radial direction of the pulverization table 18, and the layer thickness D is not constant in the vicinity of the throat. In contrast, as shown in FIG. 14B, when the table circumferential speed is high, the layer thickness D converges to a constant value in the vicinity of the throat 20, and thus the fall amount also converges to a constant value.

With the table circumferential speed being 3 m/s or higher, it is possible to converge the fall amount to a constant value, while ensuring a pulverizing performance (capacity).

Furthermore, with the table circumferential speed being 5 m/s or lower, it is possible to perform eco-friendly operation in which a power increase of the pulverizing device 10 can be avoided.

In an illustrative embodiment, as shown in FIG. 10, the throat vane 23 is oblique toward the upstream side with respect to the rotational direction of the throat 20 (rotational direction of the pulverization table 18), from the lower end toward the upper end of the throat vane 23. Further, the inclination angle θ of the throat vane 23 satisfies the following expression (d).

$$H/d \geq 0.95 \times (\sin\theta)^{-2.0} \times (L/d)^{-1.2} \quad \text{(d)}$$

Figure 15:
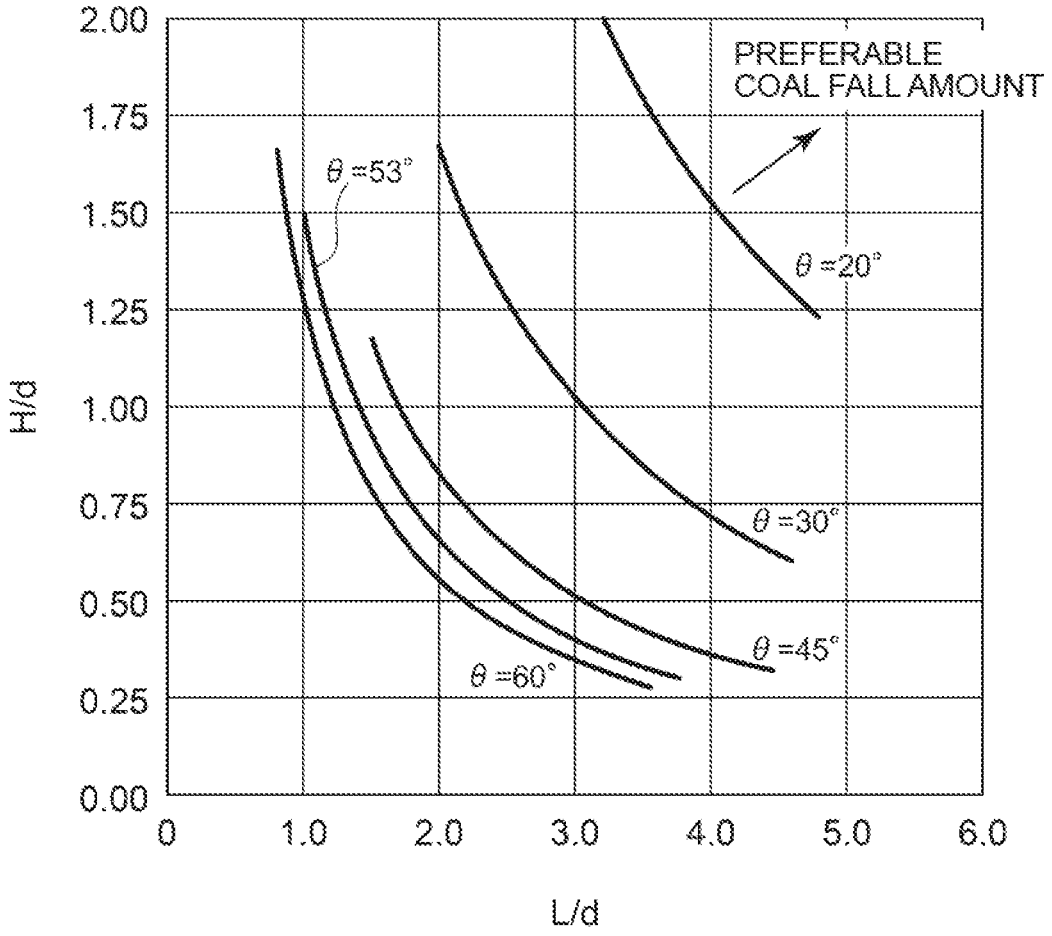
FIG. 15 is a graph showing a relationship between L/d, H/d, and θ according to an embodiment.

FIG. 15 is a graph showing a relationship between H/d, L/d, and θ, required to maintain the fall amount within a desired range (smaller than the allowable fall amount).

As shown in the drawing, the present inventors studied the influence of the changes in H/d and L/d on the fall amount, and found that, to achieve a desired fall amount, H/d can be increased to reduce L/d, and conversely, L/d can be increased to reduce H/d. That is, if the distance between the throat vanes 23 is small compared to the gap H (i.e., the number of throat vanes is relatively large), it is possible to expect the effect of the throat vanes 23 to stir the pulverized particles upward, and thus it is possible to achieve a desired fall amount even if L/d is relatively small. On the other hand, if the length L of the throat vane is large compared to the distance between adjacent throat vanes, it is possible to suppress fall of pulverized particles by contracting the air flow sufficiently inside the throat, and thus it is possible to achieve a desired fall amount even if H/d is small. On the other hand, if the length L of the throat vane is large compared to the distance 'd' between adjacent throat vanes, it is possible to suppress fall of pulverized particles P by contracting the air flow sufficiently inside the throat, and thus it is possible to achieve a desired fall amount even if H/d is small.

Further, as shown in FIG. 15, the combination of H/d and L/d capable of achieving a desired fall amount depends on the inclination angle θ of the throat vanes. Specifically, it was found that, as sin θ increases, the values H/d and L/d for achieving a desired fall amount relatively decrease. This is because, for L×sin θ represents the extension range of each throat vane in the throat circumferential direction, sin θ can be considered as a parameter representing the magnitude of the effect to stir the pulverized particles upward.

Accordingly, by setting H/d, L/d, and θ so as to satisfy the expression (d), in addition to the expressions (a) and (b), it is possible to reduce the fall amount of pulverized particles more effectively while suppressing an increase in the throat pressure loss.

In an illustrative embodiment, the throat 20 disposed on the pulverizing device 10 includes an inner ring 21, an outer ring 22 disposed on the radially outer side of the inner ring 21 and forming an annular flow passage 'fr' between the inner ring 21 and the outer ring 22, and a plurality of throat vanes 23 disposed between the inner ring 21 and the outer ring 22. Further, the gap H, the length L of the throat vanes 23, and the distance 'd' between the throat vanes 23 satisfy the above relationships (a) and (b).

With the above configuration, it is possible to reduce the fall amount by satisfying $2.0 \leq L/d$ as described above, and it is possible to suppress the pressure loss of the air flow passing through the throat by satisfying $L/d \leq 4.0$.

Further, it is possible to reduce the fall amount by satisfying $0.5 \leq H/d$, and suppress the throat pressure loss by satisfying $H/d \leq 1.5$.

Accordingly, by satisfying the expressions (a) and (b), it is possible to reduce both of the fall amount and the throat pressure loss.

In some embodiments, the pulverizing device 10 is configured to pulverize coal as the to-be-pulverized material Mr.

Accordingly, in a case where the to-be-pulverized material Mr is coal, it is possible to suppress the pressure loss of the air flow passing through the throat 20, while suppressing the fall amount of pulverized coal particles that fall from the throat 20.

Figure 16:
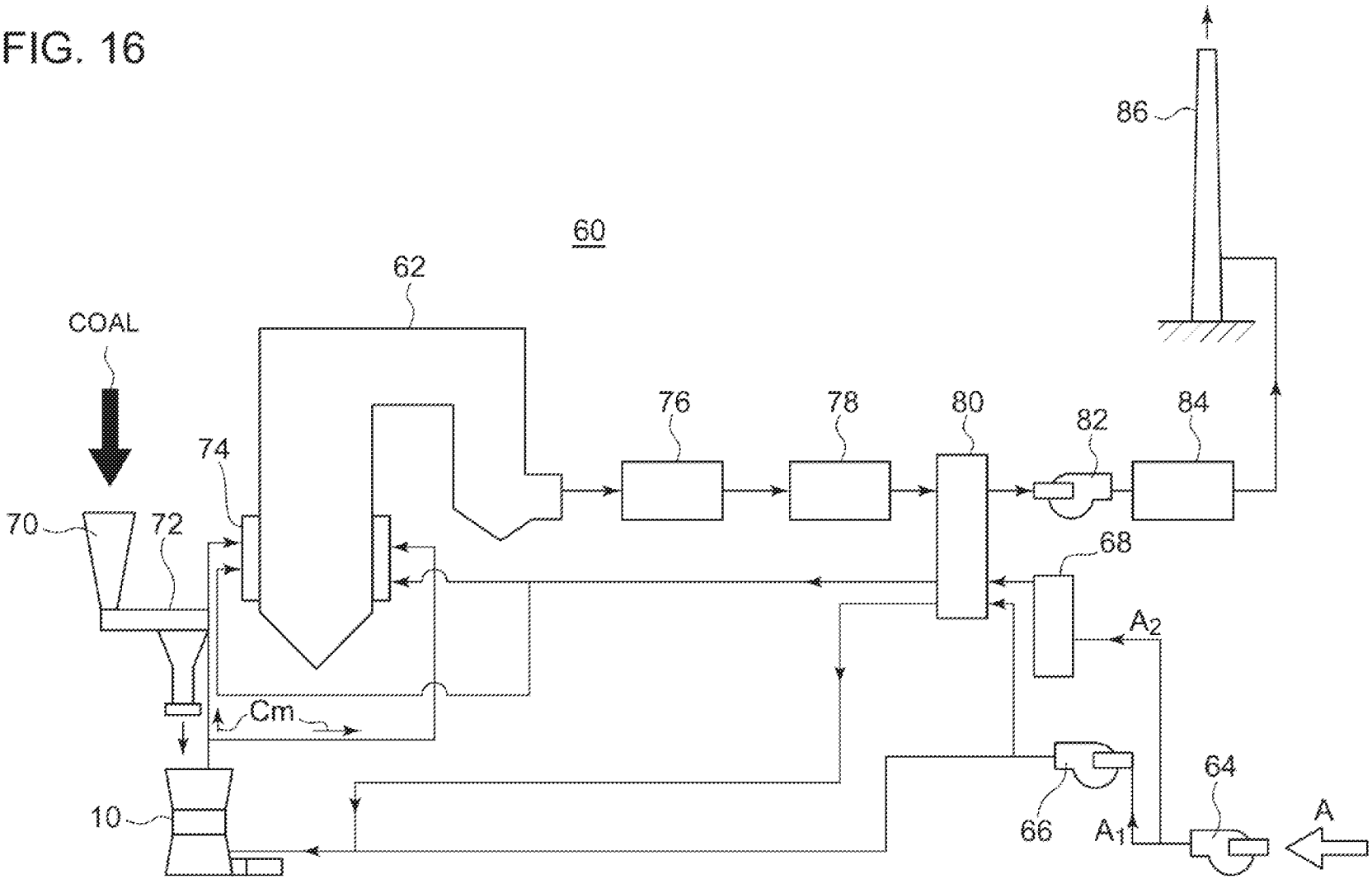
FIG. 16 is a system diagram of a pulverized-coal fired boiler according to an embodiment.

According to an embodiment, as shown in FIG. 16, a pulverized-fuel fired boiler 60 includes the pulverizing device 10, and a furnace (boiler body) 62 for combusting pulverized coal Cm obtained by the pulverizing device 10.

In the illustrated embodiment, the pulverizing device 10 is supplied with air A with a blower 64, and is fed with coal that serves as a material (to-be-pulverized material Mr) from a coal banker 70 and a coal feeder 72.

The combustion air A sent to the blower 64 is branched into air $A_1$ and air $A_2$, of which the air $A_1$ is carried to the pulverizing device 10 by a blower 66. A part of the air $A_1$ is heated by a pre-heater 80 and carried to the pulverizing device 10 as heated air. Herein, the heated air heated by the pre-heater 80 and cold air directly carried from the blower 66 without passing through the pre-heater 80 may be adjust-mixed so as to obtain mixed air having an appropriate temperature, before being supplied to the pulverizing device 10. Accordingly, the air $A_1$ supplied to the pulverizing device 10 is injected into the housing 12 from the throat 20 (see FIG. 1) inside the pulverizing device 10.

The coal serving as the to-be-pulverized material Mr is put into the coal banker 70, and then fed to the pulverizing device 10 through the coal feeder 72 by a predetermined amount, via the supply pipe 24 (see FIG. 1). The coal is pulverized by the pulverizing device 10 while being dried by the air flow 'f' of the air $A_1$ from the throat 20, and thereby pulverized coal Cm is produced, which is then carried by the air $A_1$ from the discharge part 26 (see FIG. 1) to the furnace 62 via a pulverized-coal burner (not shown) inside a wind box 74 of the furnace 62, to be ignited by the burner to combust.

Of the combustion air A sent into the blower 64, the air $A_2$ is heated by the pre-heater 68 and the pre-heater 80, sent to the furnace 62 via the wind box 74, and is used in combustion of the pulverized coal Cm inside the furnace 62.

The exhaust gas produced from combustion of the pulverized coal Cm in the furnace 62 is deprived of dust in a dust collector 76, sent to a denitrification device 78, where nitrogen oxide (NOx) contained in the exhaust gas is reduced. Further, the exhaust gas is sucked by the blower 82 via the pre-heater 80, deprived of sulfate in a desulfurization device 84, and discharged to the atmosphere from a stack 86.

With the above described pulverized-coal fired boiler 60, it is possible to return the coarse particles Pc classified from the pulverized coal Cm by the classifying part 16 of the pulverizing device 10 to the pulverization table 18 smoothly. In this way, it is possible to improve the fineness of the pulverized coal Cm having passed through the classifying part 16, and reduce the pressure loss in the housing 12, thus suppressing a power increase of the pulverizing device 10.

Furthermore, since the pulverized coal Cm containing a reduced amount of coarse particles Pc is combusted, it is possible to reduce air pollutants such as NOx in combustion gas, and reduce non-combusted components in cinder, thereby improving the boiler efficiency.

INDUSTRIAL APPLICABILITY

According to at least one embodiment of the present invention, it is possible to suppress the fall amount of pulverized particles that fall from the throat, and suppress an increase in the pressure loss in the housing to suppress a power increase of the pulverizing device. The present invention can be suitably applied to a pulverization device for a pulverized-coal fired boiler to pulverize coal as a to-be-pulverized material, for instance.

DESCRIPTION OF REFERENCE NUMERALS

10 Pulverizing device
12 Housing
14 Pulverizing part
16 Classifying part
18 Pulverization table
20 (20*a*, 20*b*) Throat
21 (21*a*, 21*b*) Inner ring
22 Outer ring
23 Throat vane
24 Supply pipe for to-be-pulverized material
26 Micro-particle discharge part
28 Pulverization roller
30 Drive part
31, 44 Motor
32 Pressurizing device
34 Carrier gas duct
36 Annular rotational part
38 Rotational fin
40 Fixed fin
42 Flow guide cone
52 Flow guide portion
60 Pulverized-fuel fired boiler
62 Furnace
Cm Pulverized coal
D Layer thickness
O Center axis
P Pulverized particle
Pc Coarse particle
Pm Micro-particle
f Air flow
fr Annular flow passage fu Upward air flow g Carrier gas

The invention claimed is:

1. A pulverizing device, comprising:

a housing;

a pulverization table configured to rotate inside the housing; and a throat, disposed inside the housing on a radially outer side of the pulverization table, for forming an upward air flow, wherein the throat includes:

an inner ring extending along an outer periphery of the pulverization table;

an outer ring, disposed on a radially outer side of the inner ring so as to form an annular flow passage between the inner ring and the outer ring;

a plurality of throat vanes disposed between the inner ring and the outer ring, and wherein, following expressions (a) and (b) are satisfied:

$$2.0 \leq L/d \leq 4.0 \quad \text{(a)}$$

$$0.5 \leq H/d \leq 1.5 \quad \text{(b)}$$

where H is a gap between the inner ring and the outer ring with respect to a radial direction, L is a length of the throat vanes, and 'd' is a distance between adjacent two of the throat vanes, wherein each throat vane is oblique toward an upstream side, with respect to a rotational direction of the throat, from a lower end toward an upper end of the throat vane, and wherein following expression (d) is satisfied:

$$H/d \geq 0.95 \times (\sin\theta)^{-2.0} \times (L/d)^{-1.2} \quad \text{(d)}$$

where θ is an inclination angle of the throat vanes with respect to a rotational center axis of the throat.

2. The pulverizing device according to claim 1, wherein each throat vane is oblique toward an upstream side, with respect to a rotational direction of the throat, from a lower end toward an upper end of the throat vane, and wherein following expression (c) is satisfied:

$$45° \leq \theta \leq 60° \quad \text{(c)}$$

where θ is an inclination angle of the throat vanes with respect to a rotational center axis of the throat.

3. The pulverizing device according to claim 1, wherein the inner ring includes a flow guide portion for guiding an air flow which flows from below into the annular flow passage, the flow guide portion being disposed on a lower end side of the inner ring and having a curved shape so as to become closer to an inner side, with respect to the radial direction, toward a lower end of the inner ring.

4. The pulverizing device according to claim 1, wherein a circumferential speed of the pulverization table is not less than 3 m/s and not more than 5 m/s.

5. A throat for a pulverizing device, comprising:

an inner ring extending along an outer periphery of a pulverization table;

an outer ring, disposed on a radially outer side of the inner ring, for forming an annular flow passage between the inner ring and the outer ring; and a plurality of throat vanes disposed between the inner ring and the outer ring, wherein following expressions (a) and (b) are satisfied:

$$2.0 \leq L/d \leq 4.0 \quad \text{(a)}$$

$$0.5 \leq H/d \leq 1.5 \quad \text{(b)}$$

where H is a gap between the inner ring and the outer ring with respect to a radial direction, L is a length of the throat vanes, and 'd' is a distance between adjacent two of the throat vanes, wherein each throat vane is oblique toward an upstream side, with respect to a rotational direction of the throat, from a lower end toward an upper end of the throat vane, and wherein following expression (d) is satisfied:

$$H/d \geq 0.95 \times (\sin\theta)^{-2.0} \times (L/d)^{-1.2} \quad \text{(d)}$$

where θ is an inclination angle of the throat vanes with respect to a rotational center axis of the throat.

6. The pulverizing device according to claim 1, configured to pulverize coal as a to-be-pulverized material.

7. A pulverized-coal fired boiler, comprising:

the pulverizing device according to claim 6; and a furnace for combusting pulverized coal obtained by the pulverizing device.

* * * * *